United States Patent [19]

Sato et al.

[11] Patent Number: 4,859,101

[45] Date of Patent: Aug. 22, 1989

[54] DEVICE FOR COOLING A CARRIAGE MOTOR AND PRINTHEAD IN A SERIAL PRINTER

[75] Inventors: Hiroyuki Sato; Akio Tajima, both of Tokyo, Japan

[73] Assignee: Seikosha Co., Ltd., Japan

[21] Appl. No.: 908,344

[22] Filed: Sep. 17, 1986

[30] Foreign Application Priority Data

Sep. 19, 1985 [JP] Japan ..... 60-207104
Sep. 19, 1985 [JP] Japan ..... 60-207105

[51] Int. Cl.[4] ..... B41J 29/00
[52] U.S. Cl. ..... 400/719; 400/693
[58] Field of Search ..... 400/124 TC, 719, 679, 400/691, 693; 310/52, 58, 59, 60 R, 60 A, 64, 65, 62, 63

[56] References Cited

U.S. PATENT DOCUMENTS

| | | | |
|---|---|---|---|
| 2,761,984 | 9/1956 | Adam et al. | 310/64 |
| 2,825,827 | 3/1958 | Luenberger | 310/60 R |
| 3,250,926 | 10/1966 | O'Reilly | 310/60 R |
| 3,848,145 | 11/1974 | Goebel | 310/60 R |
| 4,388,009 | 6/1983 | Kumagai et al. | 400/719 |
| 4,452,542 | 6/1984 | Akazawa | 400/124 |

FOREIGN PATENT DOCUMENTS

| | | | |
|---|---|---|---|
| 72889 | 5/1982 | Japan | 400/719 |
| 131587 | 8/1982 | Japan | 400/124 TC |
| 148678 | 9/1982 | Japan | 400/719 |
| 29691 | 2/1983 | Japan | 400/719 |
| 42483 | 3/1983 | Japan | 400/719 |
| 5087 | 1/1984 | Japan | 400/719 |
| 83873 | 5/1985 | Japan | 400/719 |
| 180870 | 9/1985 | Japan | 400/719 |

OTHER PUBLICATIONS

"Bidirectional DC Motor Exhaust System"; *IBM Technical Disclosure System;* vol. 24, No. 5, p. 2244; C. T. Barnard et al; Oct. 1981.

*Primary Examiner*—David A. Wiecking
*Attorney, Agent, or Firm*—Bruce L. Adams; Van C. Wilks

[57] ABSTRACT

A printer has a print head, first heat-dissipating fins disposed on the print head for dissipating heat produced by the print head, a carriage for carrying the print head, and a motor for driving the carriage. Second heat-dissipating fins are disposed on the motor for dissipating heat produced by the motor. A fan is driven by the motor for forming an air flow which is directed toward the first and second heat-dissipating fins for the efficient dissipation of heat.

14 Claims, 3 Drawing Sheets

DEVICE FOR COOLING A CARRIAGE MOTOR AND PRINTHEAD IN A SERIAL PRINTER

FIELD OF THE INVENTION

The present invention relates to a device for cooling a serial printer having a reciprocating print head that prints characters, numerals, symbols, etc. on a recording medium.

BACKGROUND OF THE INVENTION

A serial dot matrix printer having a reciprocating print head that prints characters and so forth on paper has been known, as disclosed in U.S. Pat. No. 4,452,542. The actuator of the print head generates a considerable amount of heat when the head is in operation. For this reason, heat-dissipating fins are attached to the print head of the serial dot matrix printer to prevent the head from overheating.

As the head is moved, the heat-dissipating fins move through the surrounding air. Thus, the generated heat is dissipated through the fins. In general, the mechanism of the printer is housed in a casing and, therefore, the air confined in a space through which the head travels is stagnant. Accordingly, the capability of the known heat-dissipating fins to dissipate heat is insufficient, although the fins move in contact with air as the print head equipped with the fins moves. Consequently, if the printer prints characters at a high speed, e.g., 400 characters per second, the head overheats. The head incorporates a temperature sensor for detecting overheat so that the printing operation may be automatically halted when the head overheats. However, when the head of a high-speed printer is operated continuously for a considerable period, the temperature sensor operates frequently to interrupt the printing operation.

In the past, many components of a printer, including a carriage motor and a motor for shifting the carriage to a next line to be printed, were held in a frame made of a metal plate. Therefore, the heat produced by these motors could be dissipated through this metal frame. In recent years, however, as disclosed in Japanese Patent application No. 276304/1984, the frame of a printer has tended to be made from plastic. This structure presents the problem that the heat generated by the motors are difficult to dissipate. This problem is more conspicuous in high-speed printers, and may cause the motors to overheat and break down.

SUMMARY OF THE INVENTION

Accordingly, it is an object of the present invention to provide a print head equipped with a simple structure that greatly enhances the cooling efficiency of the head.

It is another object of the invention to provide a printer which has a plastic frame to support the mechanism of the printer and which allows the heat generated by the motors, especially the heat produced by the carriage motor, to be effectively dissipated, thereby preventing the printer from overheating.

The present invention is characterized in that the output shaft of a carriage motor connected to a timing belt for driving a carriage has a fan rigidly sectured thereto, and that a wall member is disposed around the fan. The wall member is provided with an air exhaust port that faces the print head. Fins for dissipating heat are firmly fixed to the outer periphery of the carriage motor.

In this structure, when the print head is in operation, the fan which is invariably rotated by the carriage motor directs air flow toward the print head from the air exhaust port formed in the wall member to ventilate the space in which the head is placed. This structure greatly enhances the heat-dissipating or cooling efficiency of the fins of the head. The heat generated by the carriage motor is dissipated through the fins around the motor. As the motor is driven, the fan fixedly attached to the output shaft of the motor blows air to ventilate the surrounding spaces of the fins. Thus, the heat-dissipating or cooling efficiency of the fins on the carriage motor is greatly improved.

Other objects and features of the invention will appear in the course of the description thereof.

DETAILED DESCRIPTION OF THE INVENTION

Figure 1:
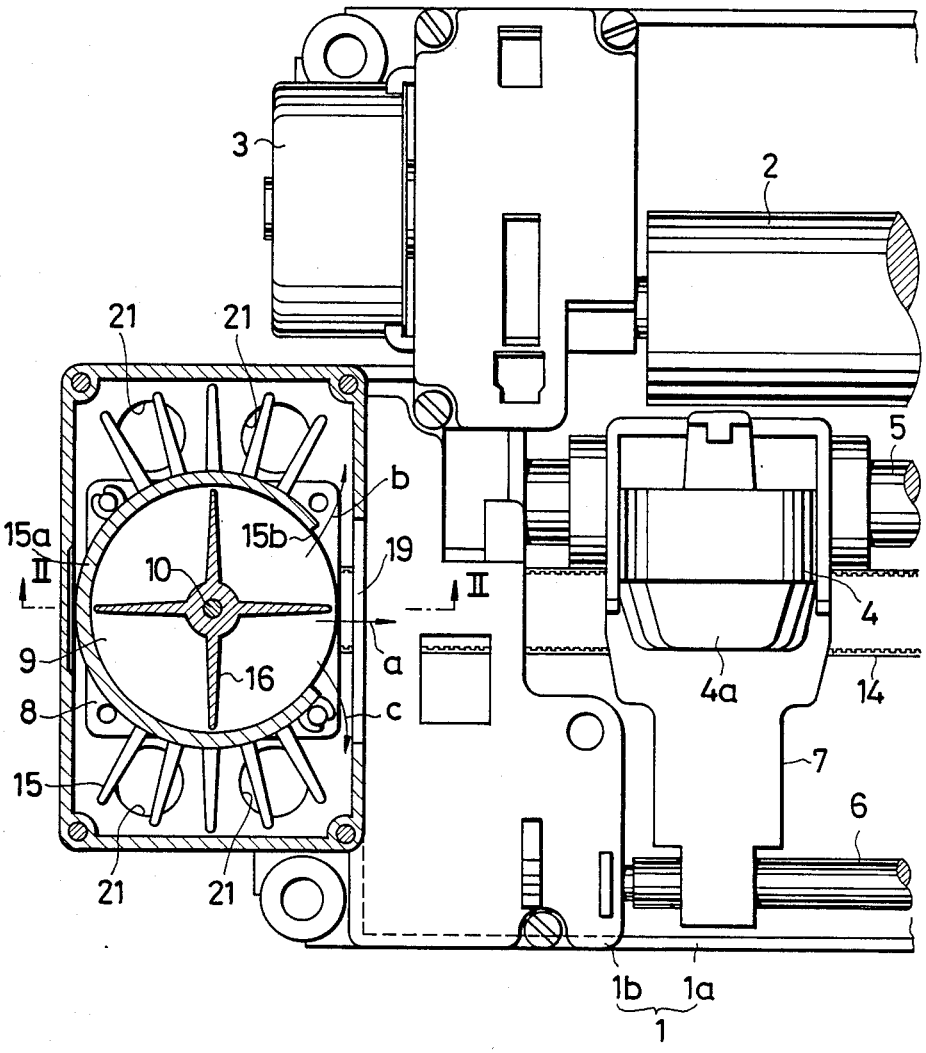
FIG. 1 is a plan view in cross section of a portion of a serial printer equipped with a cooling device according to the invention.
Figure 2:
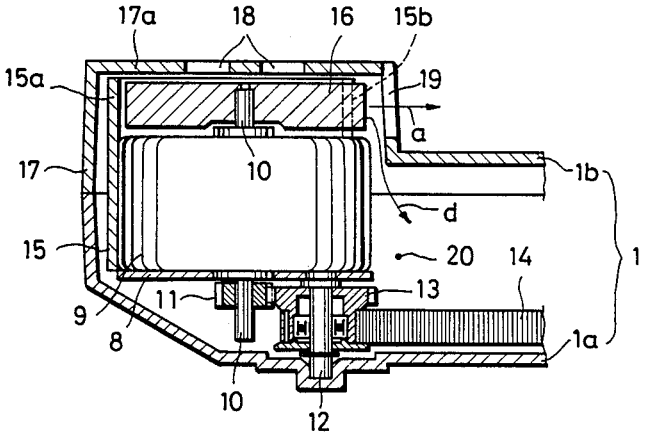
FIG. 2 is a cross-sectional view taken on line II—II of FIG. 1.
Figure 3:
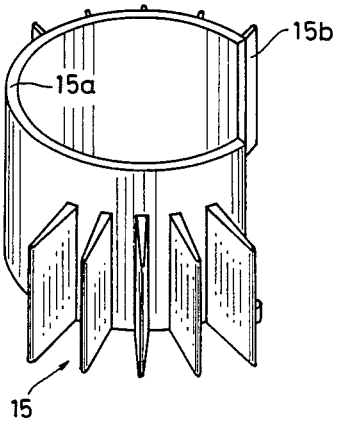
FIG. 3 is a perspective view of the heat-dissipating fins shown in FIGS. 1 and 2, the fins having a wall member integral with the fins.

Referring to FIGS. 1 and 2, there is shown a serial printer equipped with a cooling device according to the invention. The printer has a frame 1 made from plastic. The frame 1 consists of a lower frame 1*a* and an upper frame 1*b*. A platen 2 is rotatably held on the frame 1, and is rotated by an electric motor 3 that brings the platen to a next line to be printed. A print head 4 that faces the platen 2 is carried on a carriage 7 which is mounted on guide shafts 5 and 6 so as to be slidable. The head 4 reciprocates in parallel with the platen 2. Heat-dissipating fins 4*a* are mounted on the rear portion of the head 4 to dissipate the heat produced during printing operation. A carriage motor 9 is mounted on a plate 8 that is fixedly mounted on the lower frame 1*a*. The motor 9 has an output shaft 10 protruding upwardly and downwardly from the body of the motor 9. A pinion 11 is rigidly fixed to the downwardly protruding portion of the output shaft 10, and is in mesh with a belt-driving wheel 13 that is rotatably held around a shaft 12 depending from the plate 8. Thus, the bi-directional rotation of the carriage motor 9 is transmitted to the belt-driving wheel 13 via the pinion 11, so that a timing belt 14 which is engaged with the belt-driving wheel 13 is reciprocated. The belt 14 reciprocates the carriage 7 along the guide shafts 5 and 6. The endless timing belt 14 is trained around another belt-driving wheel (not shown) mounted at the right end of the frame 1.

Heat-dissipating fins 15 are mounted on the outer periphery of the body of the carriage motor 9 to dissipate the heat generated by the operation of the motor 9. A fan 16 in the form of a plurality of radial blades arranged in a crisscross is rigidly fixed to the end of the output shaft 10 protruding upwardly from the body of the motor 9. The fins 15 have a height with respect to the plate 8 substantially equal to that of the body of the motor 9. In this embodiment, a wall member 15*a* is formed integral with and extends from the upper portions of the sleeve of fins 15. This wall member or the sleeve extension 15*a* surrounds the lateral portion of the fan 16, and is provided with a cutout to form an air exhaust port 15*b* that faces the print head 4. The carriage motor 9, the fins 15, the wall member 15*a* integral with the fins 15, and the fan 16 are disposed within a casing or enclosure 17 which is formed integral with the frame 1. The top wall 17*a* of the casing 17 covers the upper portion of the fan 16, and is formed with an air intake port 18 close to the center of rotation of the fan 16. Air exhaust ports 19 and 20 are formed in the lateral portion of the casing 17. Another air exhaust port 21 is formed in the lower portion of the casing 17. The exhaust port 19 is aligned substantially opposite to the air exhaust port 15*b* of the wall member 15*a*.

When the carriage motor 9 is operated, the timing belt 14 is driven via the pinion 11 and the belt-driving wheel 13. Then, the carriage 7 is moved along the guide shafts 5 and 6. At this time, the print head 4 prints desired characters on a recording medium (not shown). The heat produced by the head 4 during the printing operation is dissipated through the fins 4*a* formed on the rear side of the head 4. Since the fan 16 is rotated by the motor 9, air is sucked from the outside of the frame 1 through the air intake port 18 and guided as indicated by the arrows a–d. The air flow discharged from the exhaust port of the wall member 15*a* is directed toward the print head 4 through the exhaust port 19. Therefore, the space through which the head 4 moves is always ventilated; hence the air inside the space is prevented from stagnating. This ventilation greatly enhances the heat-dissipating capacity of the print head 4 and the cooling efficiency of the fan 16. A portion of the air flow produced by the fan 16 is also directed to the space between the lower frame 1*a* and the upper frame 1*b* as indicated by the arrow d in FIG. 2. Also, some of the air flow is circulated within the the casing 17 as indicated by the arrows b and c in FIG. 1 and guided around the fins 15. This air flow improves the capability of the fins 15 to dissipate the heat produced by the carriage motor 9.

While the preferred embodiment of the invention has been described using specific terms, such description is for illustrative purposes only, and it is to be understood that changes and variations may be made without departing from the spirit of the invention.

Figure 4:
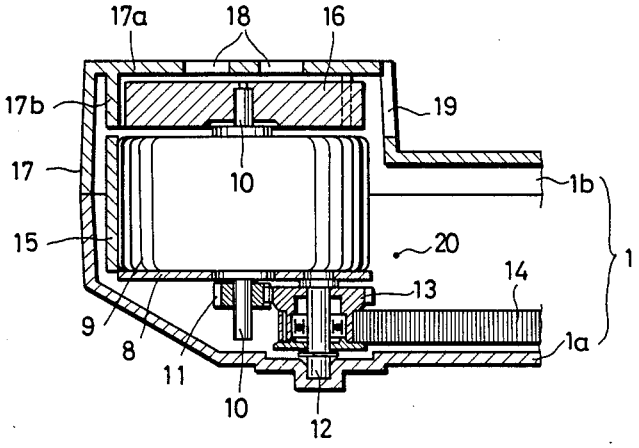
FIG. 4 is a cross-sectional view of main portions of another cooling device according to the invention.

For example, as shown in FIG. 4, an upper wall member 17*a* and a protrusion 17*b* surrounding the fan 16 may be formed integral with the casing 17, which is integral with the frame 1.

Figure 5:
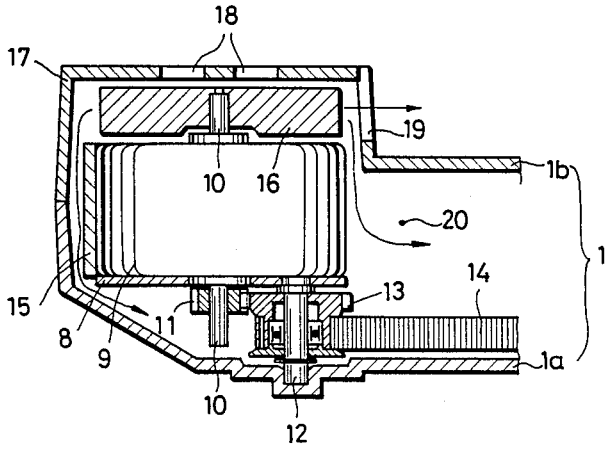
FIG. 5 is a cross-sectional view of main portions of a further cooling device according to the invention.

Another embodiment is shown in FIG. 5, where the outer wall of the casing 17 constitutes a wall member that surrounds the fan 16.

In this way, it is merely a matter of design with which component the wall member surrounding the fan 16 is formed integrally. It is also possible to mount the wall member independently. Further, the fan 16 may be mounted on the output shaft 10 of the pinion 11.

As described in detail thus far, the space in which the print head is movably installed is ventilated during the printing operation. This greatly enhances the heat-dissipating or cooling efficiency of the fins. Consequently, the print head cannot overheat even after the high-speed printer is used continuously for a long period. Hence, it is unlikely that overheat of the head interrupts the printing operation. Additionally, the carriage motor of the printer can be efficiently cooled. Therefore, even if the frame of the printer is made from plastic, or if the printer is a high-speed printer, the carriage motor moving the head is unlikely to overheat; hence the motor does not break down. Furthermore, the structure is very simple and so the printer can be cooled and prevented from overheating at a low cost.

What is claimed is:

1. In a printer having a print head, first heat-dissipating means disposed on the print head for dissipating heat produced by the print head, a reciprocable carriage carrying thereon the print head and mounted to undergo reciprocation within a defined space, and a motor for reciprocatingly driving the carriage: second heat-dissipating means disposed on the motor for dissipating heat produced by the motor; air-flow forming means driven by the motor for forming an air flow; and means defining an enclosure enclosing the air-flow forming means, the motor and the second heat-dissipating means, the enclosure having at least one air-intake port and a plurality of air-exhaust ports, at least one of the air-exhaust ports being positioned in opposed facing relation to the print head, and the enclosure coacting with the air-flow forming means to direct a portion of the air flow onto and over the second heat-dissipating means to thereby effect air cooling of the motor and to direct another portion of the air flow through the air-exhaust port which faces the print head into the defined space and onto and over the first heat-dissipating means to thereby effect air cooling of the print head.

2. A printer as claimed in claim 6; wherein the air-flow forming means comprises a fan.

3. A printer as claimed in claim 2; wherein the fan has a plurality of radial blades.

4. A printer as claimed in claim 6; wherein the second heat-dissipating means comprises a plurality of fins disposed around a peripheral surface of the motor.

5. A printer as claimed in claim 1; wherein the motor comprises a body having a peripheral surface surrounded by the second heat-dissipating means, and a drive shaft protruding from the motor body and connected to drive the air-flow forming means.

6. A printer as claimed in claim 5; wherein the second heat-dissipating means comprises a sleeve surrounding the motor body peripheral surface and a plurality of fins extending radially outwardly from the sleeve.

7. A printer as claimed in claim 6; wherein the sleeve has an extension surrounding the air-flow forming means.

8. A printer as claimed in claim 7; wherein the sleeve extension has an exhaust opening in alignment with the air-exhaust port which faces the print head.

9. A printer as claimed in claim 1; wherein the enclosure has a protrusion protruding inwardly therefrom and surrounding the air-flow forming means, the protrusion having an exhaust opening in alignment with the air-exhaust port which faces the print head.

10. A printer as claimed in claim 1; including a guide shaft for slidably guiding the carriage, and an endless timing belt driven by the motor for reciprocating the carriage along the guide shaft.

11. In a serial printer having guide means secured to a support frame, a carriage slidably supported by the guide means, a print head carried on the carriage and provided with heat-dissipating fins, and a carriage motor located at a position lateral to the print head in order to cause the carriage to reciprocate, the improvement comprising: a fan secured to an output shaft of the carriage motor and having a plurality of blades radially extending from the carriage motor output shaft; a heat-dissipating body with fins secured so as to surround the body of the carriage motor for dissipating heat produced by the carriage motor; and a casing integral with the support frame and housing therein the fan, the heat-dissipating body and the carriage motor so as to direct air flow produced by the fan toward the heat-dissipating body, the casing having at least one air-intake port and a plurality of air-exhaust ports, at least one of the air-exhaust ports being positioned to face the print head so as to direct the air flow toward the print head.

12. A serial printer as claimed in claim 11; including a wall member integrally formed with the heat-dissipating body and surrounding the fan.

13. A serial printer as claimed in claim 11; wherein the casing is formed with a wall member surrounding the fan.

14. A serial printer as claimed in claim 11; wherein the output shaft of the carriage motor protrudes in opposite directions relative to the carriage motor body, and the fan and a pinion for driving the carriage being secured to the respective protruding end portions of the output shaft.

* * * * *